US010788006B2

(12) United States Patent
Lorenz et al.

(10) Patent No.: US 10,788,006 B2
(45) Date of Patent: Sep. 29, 2020

(54) METHOD AND APPARATUS TO CONTROL AN IGNITION SYSTEM

(71) Applicant: Delphi Automotive Systems Luxembourg SA, Bascharage (LU)

(72) Inventors: Frank Lorenz, Trier (DE); Peter Weyand, Bertrange (LU)

(73) Assignee: DELPHI AUTOMOTIVE SYSTEMS LUXEMBOURG SA (LU)

( * ) Notice: Subject to any disclaimer, the term of this patent is extended or adjusted under 35 U.S.C. 154(b) by 206 days.

(21) Appl. No.: 15/774,518

(22) PCT Filed: Nov. 8, 2016

(86) PCT No.: PCT/EP2016/076983
§ 371 (c)(1),
(2) Date: May 8, 2018

(87) PCT Pub. No.: WO2017/081007
PCT Pub. Date: May 18, 2017

(65) Prior Publication Data

US 2019/0301421 A1 Oct. 3, 2019

(30) Foreign Application Priority Data

Nov. 9, 2015 (GB) ..... 1519699.1

(51) Int. Cl.
*F02P 9/00* (2006.01)
*F02P 15/10* (2006.01)
*F02P 7/077* (2006.01)

(52) U.S. Cl.
CPC ..... *F02P 9/00* (2013.01); *F02P 7/077* (2013.01); *F02P 15/10* (2013.01)

(58) Field of Classification Search
CPC .... F02P 7/077; F02P 9/00; F02P 9/002; F02P 9/007; F02P 15/10
USPC ..... 307/10.6, 104
See application file for complete search history.

(56) References Cited

U.S. PATENT DOCUMENTS 3,218,512 A 11/1965 Quinn
4,702,221 A 10/1987 Tokura et al.
2011/0006693 A1* 1/2011 Olsson ..... F02P 1/086 315/209 CD (Continued)

FOREIGN PATENT DOCUMENTS

CN 201181633 Y 1/2009
EP 2325476 A1 5/2011
EP 2873850 A1 5/2015

(Continued)

*Primary Examiner* — William Hernandez
(74) *Attorney, Agent, or Firm* — Joshua M. Haines

(57) ABSTRACT

A multi-charge ignition system including a spark plug control unit adapted to control at least two coil stages so as to successively energise and de-energise the coil stages to provide a current to a spark plug, the two stages including a first transformer including a first primary winding inductively coupled to a first secondary winding a second transformer including a second primary winding inductively coupled to a second secondary winding. A first switch is located between the high end side of the first primary winding and the high end side of the second primary winding, and a second switch is located between the low side of the first primary winding and high side of the second primary winding.

7 Claims, 4 Drawing Sheets

(56) References Cited

U.S. PATENT DOCUMENTS

| | | | | |
|---|---|---|---|---|
| 2015/0192100 | A1 | 7/2015 | Kurahashi et al. | |
| 2016/0298593 | A1* | 10/2016 | Lorenz | F02D 41/009 |

FOREIGN PATENT DOCUMENTS

| | | | |
|---|---|---|---|
| EP | 2876298 | A1 | 5/2015 |
| JP | 07220955 | A | 8/1995 |
| JP | 2015200279 | A | 11/2015 |

* cited by examiner

METHOD AND APPARATUS TO CONTROL AN IGNITION SYSTEM

CROSS REFERENCE TO RELATED APPLICATIONS

This application is a national stage application under 35 USC 371 of PCT Application No. PCT/EP2016/076983 having an international filing date of Nov. 8, 2016, which is designated in the United States and which claimed the benefit of GB Patent Application No. 1519699.1 filed on Nov. 9, 20015, the entire disclosures of each are hereby incorporated by reference in their entirety.

TECHNICAL FIELD

The present invention relates to an ignition system and method of controlling spark plugs. It has particular but not exclusive application to systems which are adapted to provide a continuous spark, such as a multi-spark plug ignition system.

BACKGROUND OF THE INVENTION

Ignition engines that use very lean air-fuel mixtures have been developed, that is, having a higher air composition to reduce fuel consumption and emissions. In order to provide a safe ignition it is necessary to have a high energy ignition source. Prior art systems generally use large, high energy, single spark ignition coils, which have a limited spark duration and energy output. To overcome this limitation and also to reduce the size of the ignition system multi-charge ignition systems have been developed. Multi-charge systems produce a fast sequence of individual sparks, so that the output is a long quasi-continuous spark. Multi-charge ignition methods have the disadvantage that the spark is interrupted during the recharge periods, which has negative effects, particularly noticeable when high turbulences are present in the combustion chamber. For example this can lead to misfire, resulting in higher fuel consumption and higher emissions.

An improved multi-charge system is described in European Patent EP2325476 which discloses a multi-charge ignition system without these negative effects and, at least partly, producing a continuous ignition spark over a wide area of burn voltage, delivering an adjustable energy to the spark plug and providing with a burning time of the ignition fire that can be chosen freely.

One drawback of current systems is the high primary current peak at the initial charge. That current peak is unwanted, it generates higher copper-losses, higher EMC-Emissions and acts as a higher load for the onboard power generation (generator/battery) of the vehicle. One option to minimize the high primary current peak is a DC/DC converter in front of the ignition coil (e.g. 48 V). However this introduces extra cost.

It is an object of the invention to minimize the high primary current peak without the use of a DC/DC converter.

STATEMENT OF THE INVENTION

In one aspect is provided a multi-charge ignition system including a spark plug control unit adapted to control at least two coil stages so as to successively energise and de-energise said coil stage(s) to provide a current to a spark plug, said two stages comprising a first transformer (T1) including a first primary winding (L1) inductively coupled to a first secondary winding (L2); a second transformer (T2) including a second primary winding (L3) inductively coupled to a second secondary winding (L4); characterised in including first switch means M2 located between the high end side of the first primary winding and high end side of the second primary winding, and second switch means M3 located between the low side of the first primary winding and high side of the second primary winding.

The system may include a step-down converter stage located between said control unit and coil stage(s), said step-down converter including a third switch (M1) and a diode (D3), said control unit being enabled to control said third switch to selectively provide power to said coil stages.

The system may include fourth and fifth switches Q1 and Q2 controlled by said control unit, said fourth and fifth connecting the low side of said first and primary winding respectively to ground.

The control unit may be enabled to simultaneously energize and de-energize primary windings (L1, L3) by simultaneously switching on and off two said corresponding fourth and fifth switches (Q1, Q2) to sequentially energize and de-energize primary windings (L1, L3) by sequentially switching on and off both corresponding switches (Q1, Q2) to maintain a continuous ignition fire.

For a multi-charge ignition cycle, during an initial energisation/ramp up phase of said primary coil of said first stage, said control unit may be adapted to close said second switch M3 and open said first switch M2 so as to connect the primary coil of both stages in series.

Said first and second switches may be provided with control lines from said control unit.

Also provided is a method of controlling the above systems where during an initial energisation/ramp-up phase of said primary coil of said first stage in a multi-charge ignition cycle, comprising closing said second switch M3 and opening said first switch M2 so as to connect the primary coil of both stages in series.

BRIEF DESCRIPTION OF DRAWINGS

The invention will now be described by way of example and with reference of the following drawings of which.

PRIOR ART

Figure 1:
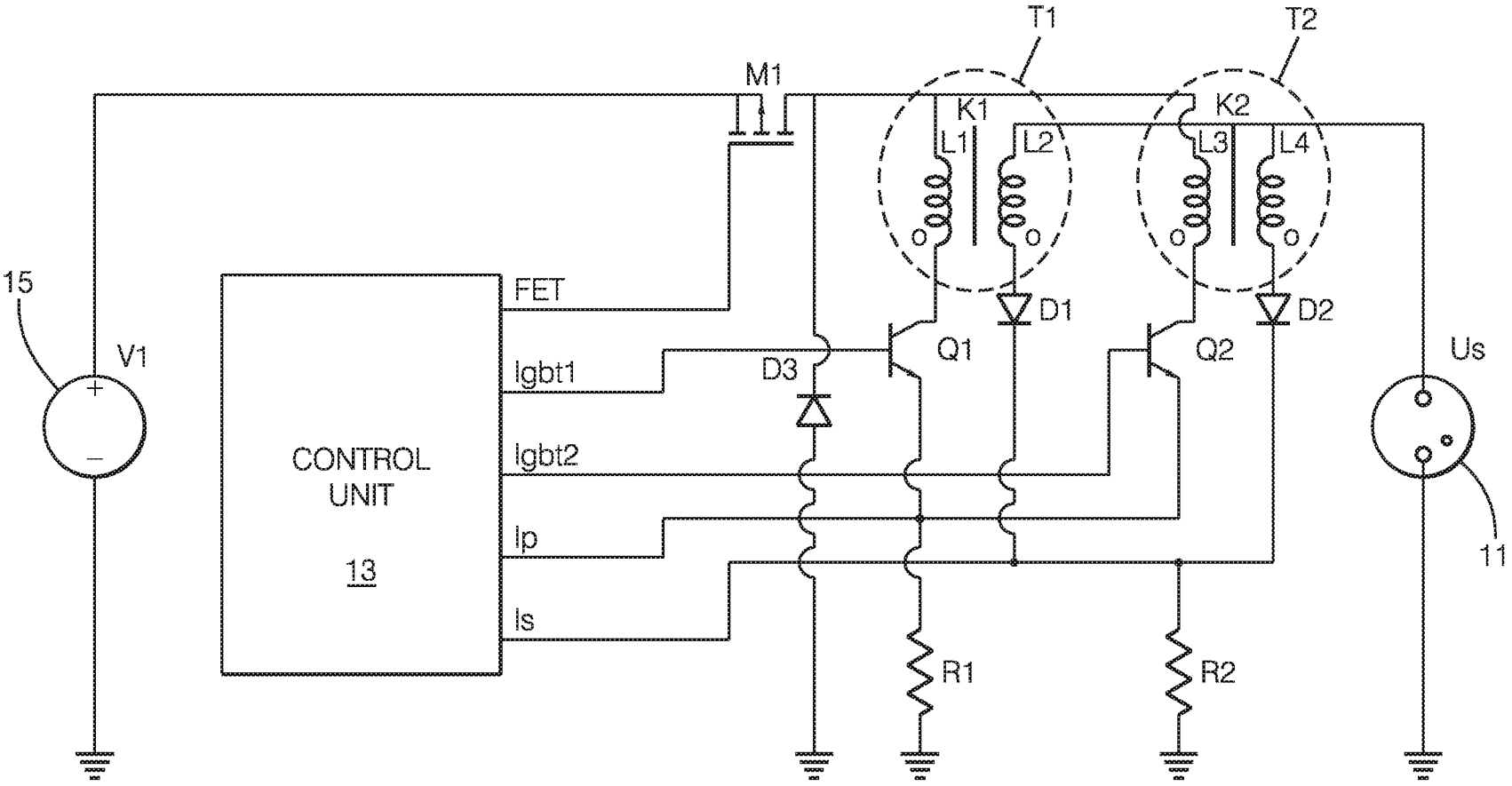
FIG. 1 PRIOR ART
FIG. 1 shows the circuitry of a prior art coupled-multi-charge ignition system.

FIG. 1 shows the circuitry of a prior art coupled-multi-charge ignition system for producing a continuous ignition spark over a wide area of burn voltage servicing a single set of gapped electrodes in a spark plug 11 such as might be associated with a single combustion cylinder of an internal combustion engine (not shown). The CMC system uses fast charging ignition coils (L1-L4), including primary windings, L1, L2 to generate the required high DC-voltage. L1 and L2 are wound on a common core K1 forming a first transformer (coil stage) and secondary windings L3, L4 wound on another common core K2 are forming a second transformer (coil stage). The two coil ends of the first and second primary 20 windings L1, L3 may be alternately switched to a common ground such as a chassis ground of an automobile by electrical switches Q1, Q2. These switches Q1, Q2 are preferably Insulated Gate Bipolar Transistors. Resistor R1 may be optionally present for measuring the primary current Ip that flows from the primary side and is connected between the switches Q1, Q2 and ground, while optional resistor R2 for measuring the secondary current Is that flows from the secondary side is connected between the diodes D1, D2 and ground.

The low-voltage ends of the secondary windings L2, L4 may be coupled to a common ground or chassis ground of an automobile through high-voltages diodes D1, D2. The high-voltage ends of the secondary ignition windings L2, L4 are coupled to one electrode of a gapped pair of electrodes in a spark plug 11 through conventional means. The other electrode of the spark plug 11 is also coupled to a common ground, conventionally by way of threaded engagement of the spark plug to the engine block. The primary windings L1, L3 are connected to a common energizing potential which may correspond to conventional automotive system voltage in a nominal 12V automotive electrical system and is in the figure the positive voltage of battery. The charge current can be supervised by an electronic control circuit 13 that controls the state of the switches Q1, Q2. The control circuit 13 is for example responsive to engine spark timing (EST) signals, supplied by the ECU, to selectively couple the primary windings L1 and L2 to system ground through switches Q1 and Q2 respectively controlled by signals Igbt1 and Igbt2, respectively. Measured primary current Ip and secondary current Is may be sent to control unit 13. Advantageously, the common energizing potential of the battery 15 is coupled by way of an ignition switch M1 to the primary windings L1, L3 at the opposite end that the grounded one. Switch M1 is preferably a MOSFET transistor. A diode D3 or any other semiconductor switch (e.g. MOSFET) is coupled to transistor M1 so as to form a step-down converter. Control unit 13 is enabled to switch off switch M1 by means of a signal FET. The diode D3 or any other semiconductor switch will be switched on when M1 is off and vice versa.

In prior art operation, the control circuit 13 is operative to provide an extended continuous high-energy arc across the gapped electrodes. During a first step, switches M1, Q1 and Q2 are all switched on, so that the delivered energy of the power supply 15 is stored in the magnetic circuit of both transformers (T1, T2). During a second step, both primary windings are switched off at the same time by means of switches Q1 and Q2. On the secondary side of the transformers a high voltage is induced and an ignition spark is created through the gapped electrodes of the spark plug 11. During a third step, after a minimum burn time wherein both transformers (T1, T2) are delivering energy, switch Q1 is switched on and switch Q2 is switched off (or vice versa). That means that the first transformer (L1, L2) stores energy into its magnetic circuit while the second transformer (L3, L4) delivers energy to spark plug (or vice versa). During a fourth step, when the primary current Ip increases over a limit (Ipmax), the control unit detects it and switches transistor M1 off. The stored energy in the transformer (L1, L2 or L3, L4) that is switched on (Q1, or Q2) impels a current over diode D3 (step-down topology), so that the transformer cannot go into the magnetic saturation, its energy being limited. Preferably, transistor M1 will be permanently switched on and off to hold the energy in the transformer on a constant level. During a fifth step, just after the secondary current Is falls short of a secondary current threshold level (Ismin) the switch Q1 is switched off and the switch Q2 is switched on (or vice versa). Then steps 3 to 5 will be iterated by sequentially switching on and off switches Q1 and Q2 as long as the control unit switches both switches Q1 and Q2 off.

Figure 2:
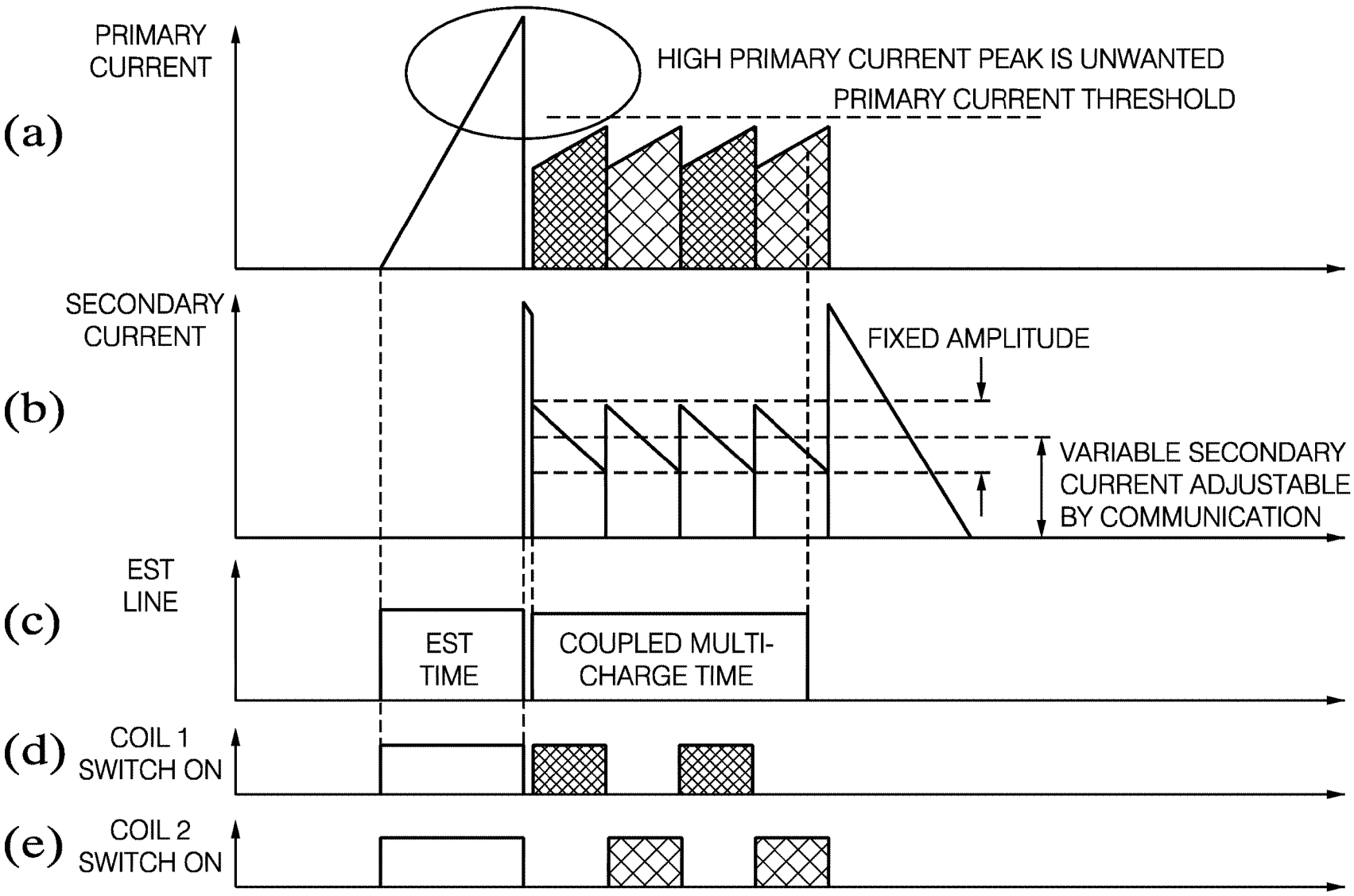
FIG. 2 shows timeline of the FIG. 1 systems for primary and secondary current, EST signal and coil 1 switch and coil 2 switch "on" times.

FIG. 2 shows timeline of ignition system current; FIG. 2*a* shows a trace representing primary current Ip along time. FIG. 2*b* shows the secondary current Is. FIG. 2*c* shows the signal on the EST line which is sent from the ECU to the ignition system control unit and which indicates ignition time. During step 1, i.e. M1, Q1 and Q2 switched on, the primary current Ip is increasing rapidly with the energy storage in the transformers. During step 2, i.e. Q1 and Q2 switched off, the secondary current Is is increasing and a high voltage is induced so as to create an ignition spark through the gapped electrodes of the spark plug. During step 3, i.e. Q1 and Q2 are switched on and off sequentially, so as to maintain the spark as well as the energy stored in the transformers. During step 4, comparison is made between primary current Ip and a limit Ipth. When Ip exceeds Ipth M1 is switched off, so that the "switched on" transformer cannot go into the magnetic saturation, by limiting its stored energy. The switch M1 is switched on and off in this way, that the primary current Ip is stable in a controlled range. During step 5, comparison is made between the secondary current Is and a secondary current threshold level Isth. If Is <Isth, Q1 is switched off and Q2 switched on (or vice versa). Then steps 3 to 5 will be iterated by sequentially switching on and off Q1 and Q2 as long as the control unit switches both Q1 and Q2 off. Because of the alternating charging and discharging of the two transformers the ignition system delivers a continuous ignition fire. The above describes the circuitry and operation of a prior art ignition system to provide a background to the current invention. In some aspects of the invention the above circuitry can be used. The invention provides various solutions to enhance performance and reduce spark-plug wear. FIGS. 2*d* and *e* show the operating states of the respective coils by virtue of the switch on and off times.

DETAILED DESCRIPTION OF THE INVENTION

Example 1

Figure 3:
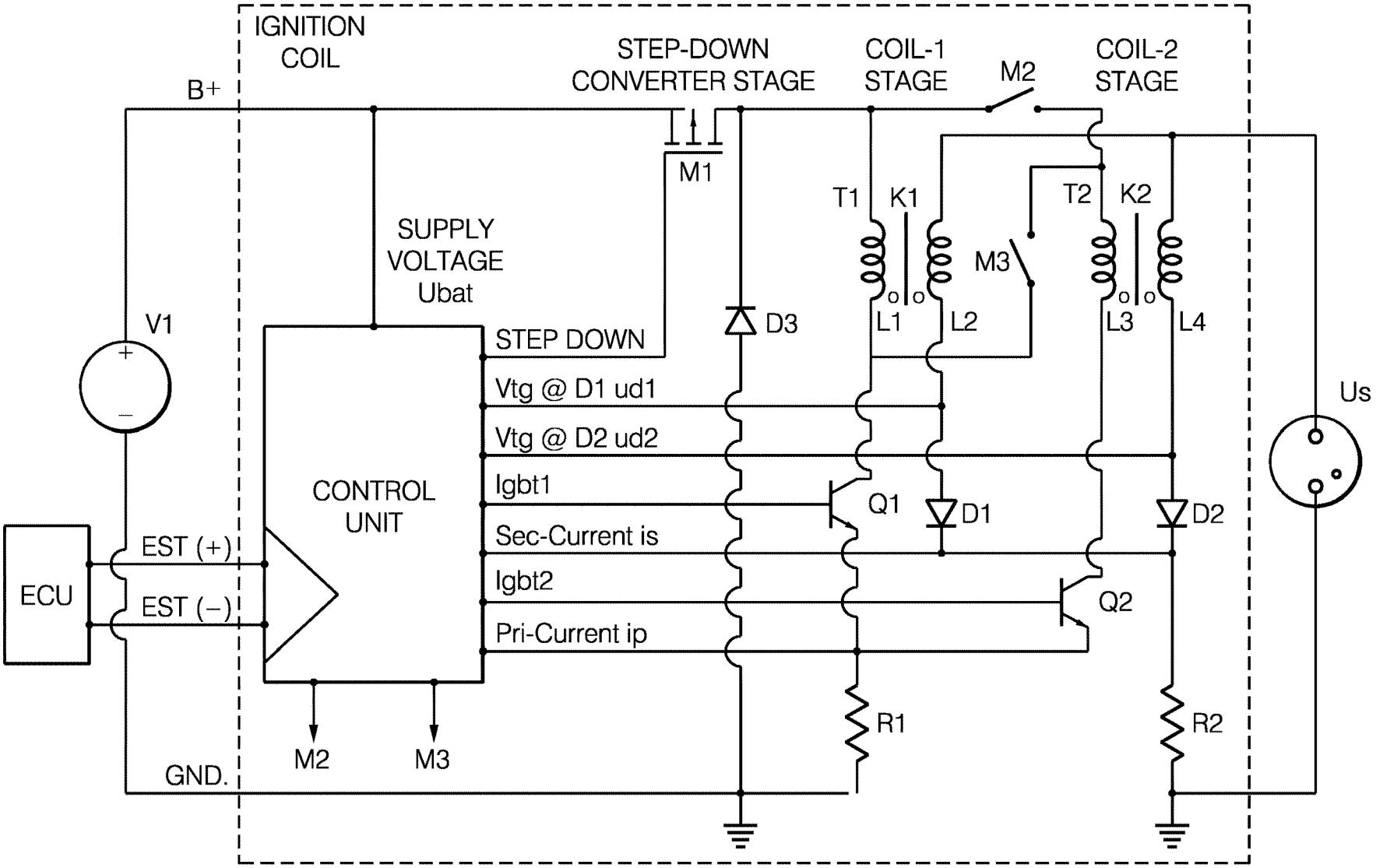
FIG. 3 shows a circuit of a coupled multi-charge system according to one example.

FIG. 3 shows a circuit according to one example—it is similar to that of FIG. 1. The circuit may include means to measure the voltage at the high voltage HV-diodes (D1 and D2), though this is optional, The supply voltage (Ubat) can additionally and optionally be measured.

In this example there are two further switches are provided: switch M2 located between the connection to the high side of the primary winding of coil stage 1 and the high side of primary winding of stage 2; and switch M3, located between the low side of primary winding of stage 1 and high side of primary winding of coil stage 2. These may be controlled by the ECU and/or spark control unit. When switch M3 is closed and M2 opened, the coils L1 and L3 (i.e. the primary coils) are effectively connected in series rather than in parallel.

Figure 4:
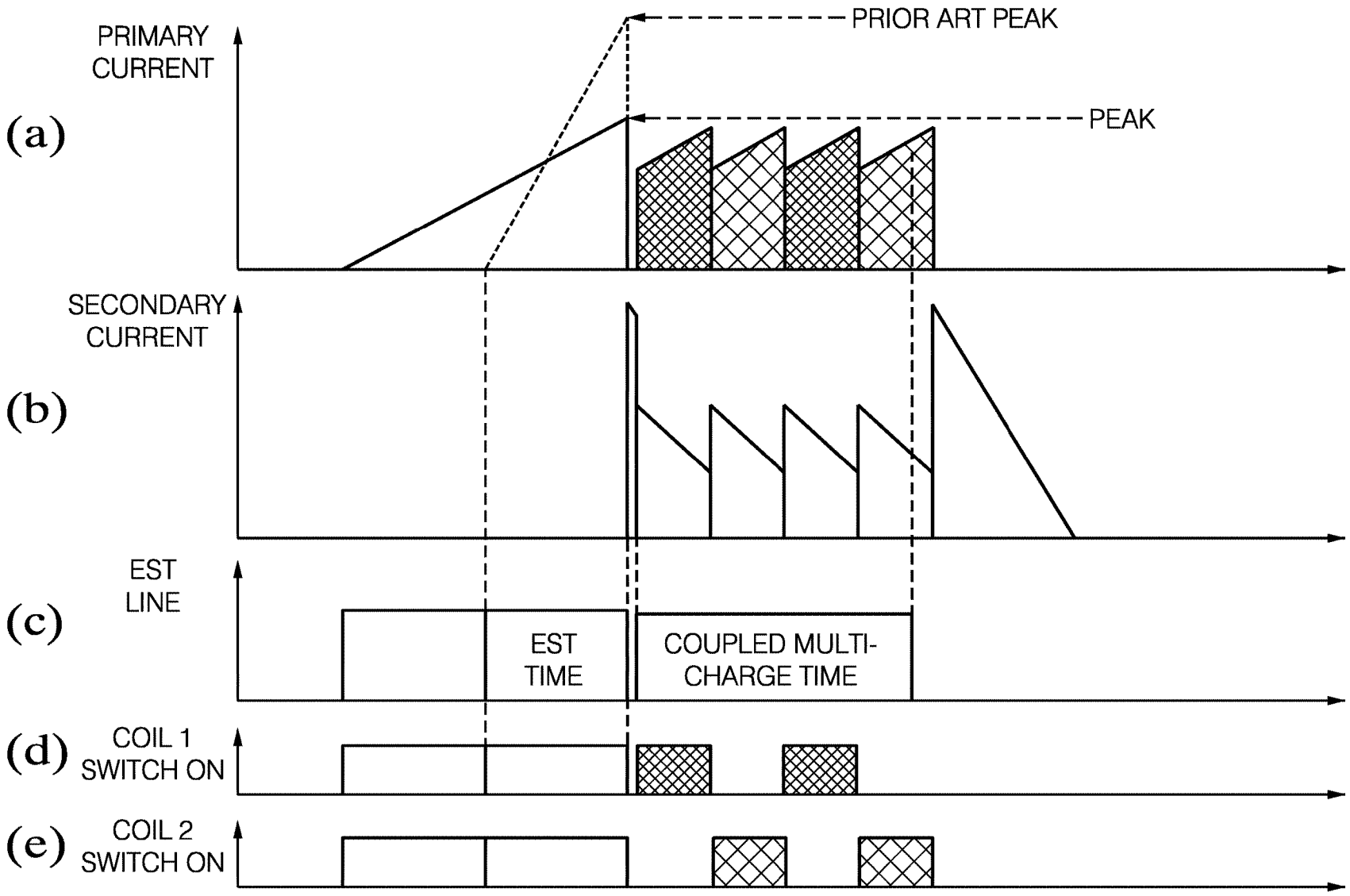
FIG. 4 shows timeline of the FIG. 3 system with the same parameters as in FIG. 2.

FIG. 4 is similar to FIG. 2 and shows plots of primary current, secondary current, EST signal and operating states of the respective coils during operation of the FIG. 3 circuit according to one method, during a multi-spark ignition cycle.

In the initial phase of a multi-charge (spark) ignition cycle, (e.g. when the EST pulse goes high to activate the ignition), and where the primary current is ramped up, switch M3 is closed and switch M2 is opened. M1 is switched on to provided current to both the windings L1 and L2. As a consequence the primary current will ramp up at a shallower gradient compared to FIG. 2*a* as shown in FIG. 4*a*. (the ramp up peak of the prior art design is superimposed in FIG. 4*a*) for comparison.

The switches M2 and M3 may controlled by the ignition coil controller which may include respective control lines to control the switches, partially shown in the figure.

In order to achieve the requisite charging, the EST pulse with regard to the initial ramp up charge period may be extended as shown in FIG. 4*c* (compared to FIG. 2*c*). After the discharge of energy to the spark plug, the coils 1 and 2 are switched alternately to provide alternate charge and discharge of the first and second stages, as is conventional in multi-spark systems.

The invention claimed is:

1. A multi-charge ignition system comprising:

at least two coil stages comprising a first transformer including a first primary winding inductively coupled to a first secondary winding and a second transformer including a second primary winding inductively coupled to a second secondary winding;

a first switch means electrically connected between a high end side of the first primary winding and a high end side of the second primary winding;

a second switch means electrically connected between a low side of the first primary winding and the high end side of the second primary winding; and a spark plug control unit adapted to control the at least two coil stages so as to successively energise and de-energise the at least two coil stages to provide a current to a spark plug.

2. A multi-charge ignition system as claimed in claim 1 further comprising a step-down converter stage electrically connected between the spark plug control unit and the at least two coil stages, the step-down converter stage including a third switch and a diode, the spark plug control unit being enabled to control the third switch to selectively provide power to the at least two coil stages.

3. A multi-charge ignition system as claimed in claim 1 further comprising:

a fourth switch controlled by the spark plug control unit and electrically connected between the low side of the first primary winding and ground; and a fifth switch controlled by the spark plug control unit and electrically connected between a low side of the second primary winding and ground.

4. A multi-charge ignition system as claimed in claim 3, wherein the spark plug control unit is enabled to simultaneously energize and de-energize the first primary winding and the second primary winding by simultaneously switching on and off the fourth and fifth switches to sequentially energize and de-energize the first primary winding and the second primary winding by sequentially switching on and off both the fourth and fifth switches to maintain a continuous ignition fire.

5. A multi-charge ignition system as claimed in claim 1, wherein for a multi-charge ignition cycle, during an initial energisation/ramp up phase of the first primary winding, the control unit is adapted to close the second switch means and open the first switch means so as to connect the first primary winding and the second primary winding in series.

6. A multi-charge ignition system as claimed in claim 1, wherein the first switch means and the second switch means are provided with control lines from the spark plug control unit.

7. A method of controlling a multi-charge ignition system having at least two coil stages having a first transformer including a first primary winding inductively coupled to a first secondary winding and a second transformer including a second primary winding inductively coupled to a second secondary winding; a first switch means electrically connected between a high end side of the first primary winding and a high end side of the second primary winding; a second switch means electrically connected between a low side of the first primary winding and the high end side of the second primary winding; and a spark plug control unit adapted to control the at least two coil stages so as to successively energise and de-energise the at least two coil stages to provide a current to a spark plug, the method comprising:

during an initial energisation/ramp-up phase of the first primary winding in a multi-charge ignition cycle, closing the second switch means and opening the first switch means so as to connect the first primary winding and the second primary winding in series.

* * * * *